United States Patent [19]

Kypreos-Pantazis

[11] Patent Number: 4,683,852

[45] Date of Patent: Aug. 4, 1987

[54] INTERNAL COMBUSTION ENGINE HAVING ROTATING PISTONS

[76] Inventor: Georg Kypreos-Pantazis, Schwindstrasse 5, 8000 Munchen 40, Fed. Rep. of Germany

[21] Appl. No.: 678,407

[22] Filed: Dec. 5, 1984

[51] Int. Cl.[4] ..... F02B 53/04

[52] U.S. Cl. ..... 123/230; 123/228

[58] Field of Search ..... 123/228; 418/142, 143; 277/203; 123/230

[56] References Cited

U.S. PATENT DOCUMENTS

| | | | |
|---|---|---|---|
| 1,001,320 | 8/1911 | Stevenson | 123/228 |
| 1,013,885 | 1/1912 | McConnell | 123/228 X |
| 1,561,356 | 11/1925 | Pryts | 277/203 |
| 1,592,704 | 7/1926 | Pfeiffer | 277/203 |
| 2,760,466 | 8/1956 | Black, Jr. | 123/13 |
| 2,939,438 | 6/1960 | Bush | 123/228 |
| 3,323,500 | 6/1967 | Murin | 123/228 |

FOREIGN PATENT DOCUMENTS

| | | | |
|---|---|---|---|
| 348352 | 2/1922 | Fed. Rep. of Germany | 123/230 |
| 1551085 | 10/1970 | Fed. Rep. of Germany . | |
| 2355372 | 6/1974 | Fed. Rep. of Germany . | |

*Primary Examiner*—Michael Koczo
*Assistant Examiner*—Richard R. Cole
*Attorney, Agent, or Firm*—Stevens, Davis, Miller & Mosher

[57] ABSTRACT

A novel internal combustion engine has a single toroidal cylinder and a set of pistons, e.g. four, which are set in a circle and rotate in the toroid. The toroid can be interrupted by separating walls to form, with the pistons, compression or expansion chambers, so enabling four stroke e.g. Otto operation. The separating walls can be withdrawn and reinserted to allow the pistons to pass. Output is direct e.g. by a shaft in the center of a disc whose periphery carries the pistons.

6 Claims, 5 Drawing Figures

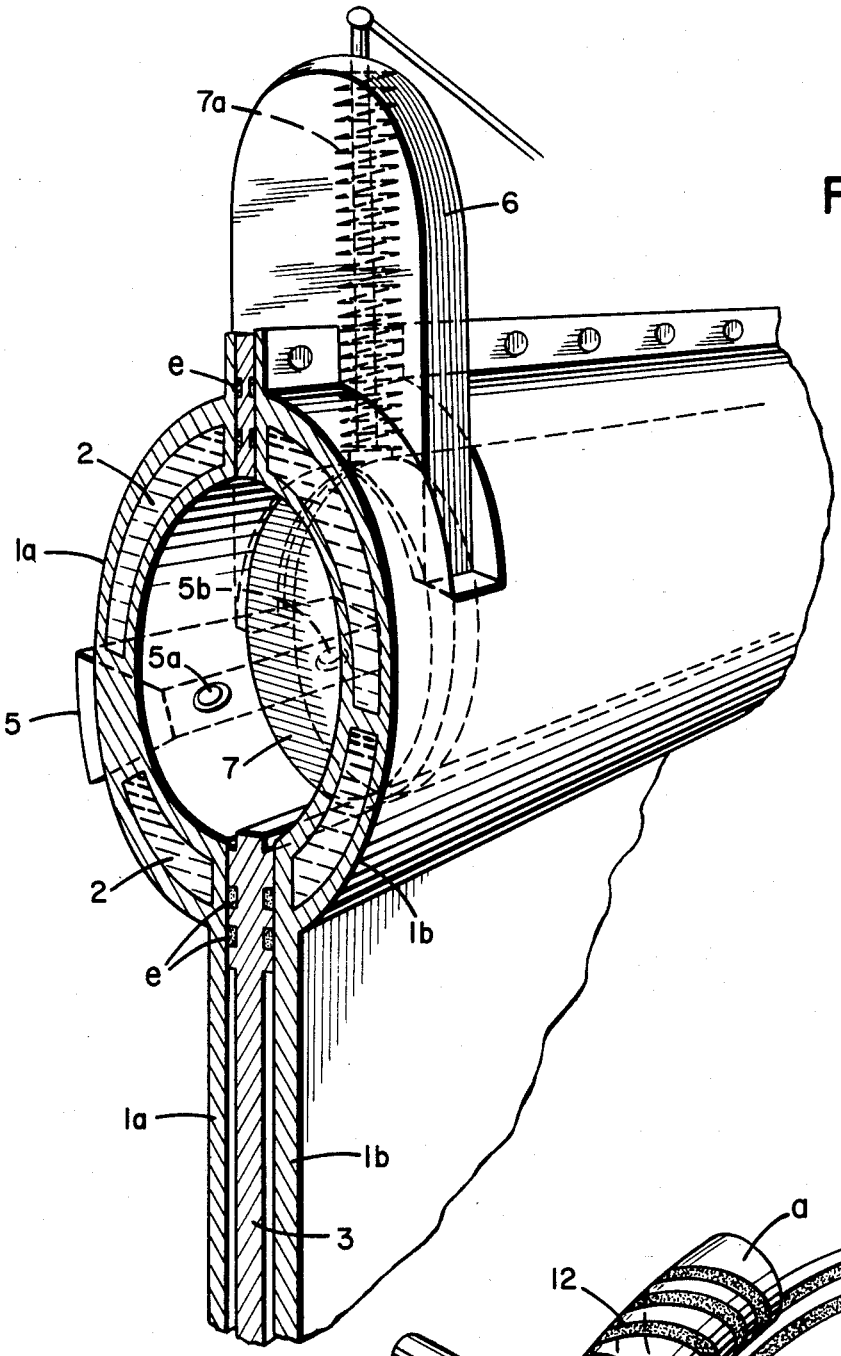
FIG. 2
FIG. 4
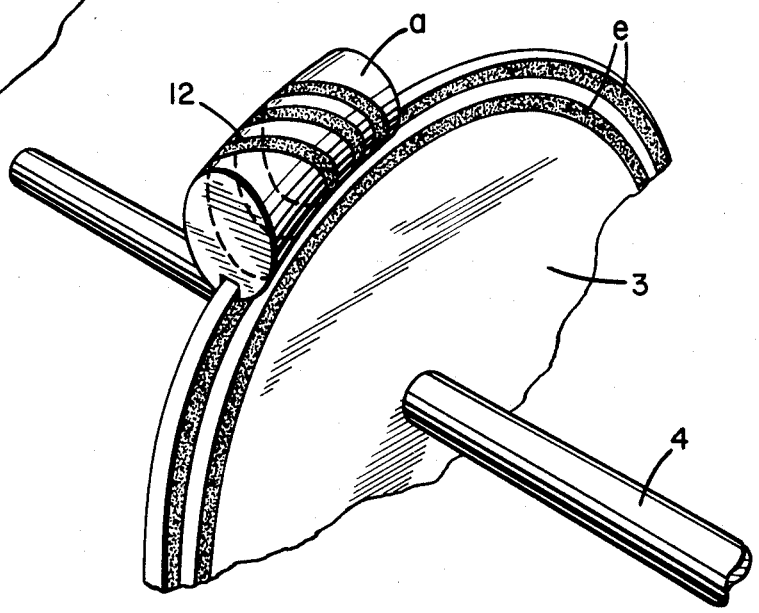

INTERNAL COMBUSTION ENGINE HAVING ROTATING PISTONS

The invention relates to a rotating piston internal combustion engine.

BACKGROUND TO THE INVENTION

In accordance with the known state of the art, in internal combustion engines thermal energy is converted into kinetic energy. By the combustion of a fuel-/air mixture in the interior of a cylinder a high pressure is created which works on a piston which is connected to a connecting rod and crankshaft system to effect the rotation of a drive shaft.

Internal combustion engines which have, up until now, found practical application are:

A. Oscillating piston combustion engines such as
   1. The Otto cycle engine (Nikolaus Otto, 1832–1891) and its alternatives.
   2. The diesel engine (Rudolph Diesel, 1858–1913) and its alternatives.

B. Rotary piston internal combustion engines The Wankel Motor, NSU (Felix Wankel, first demonstration 1960) and its alternative constructions.

The motors noted under A above have substantial disadvantages which limit the maximum efficiency to about 25 to 30%, although the motor industry currently is striving worldwide to improve the degree of efficiency. It is known that the disadvantages reside in (a) the fact that two complete revolutions of the drive shaft are necessary in order to effect the necessary operating cycle of four strokes (induction, compression, expansion and exhaust). This means that for two revolutions the work of only one explosion is available and accordingly the torque is correspondingly low, (b) the known fact that the uniformity factor of the customary four stroke engine is small and the useful mechanical power output is yet further reduced by the valve drive, (c) the substantial thermal losses relative to the power of the engine, (d) the complexity of the overall engine construction and the relatively high manufacturing cost connected therewith on account of the large number of moving parts, the uneven upward and downward movement of the pistons, the shape and method of manufacture of the crankshaft and the necessary cylinder head construction.

The rotary piston engines (Wankel Engines) noted under B above have the following important disadvantages:

(1) the still eccentric mounting of the piston on the drive shaft, (2) the transfer of force from the circular piston by means of gear teeth onto the drive shaft and the friction losses and noise connected therewith, (3) the irregulariy of the operation chamber, which adversely affects the functioning of the motor, (4) because of the triangular form of the circular piston sealing problems arise which give rise to a diminution in the power of the engine, (5) because of the geometry of the operation chamber substantial fuel/air mixture losses arise and (6) the torque is in comparison larger than that of the oscillating piston engines; however in principle it cannot substantially be raised any further.

Therefore one object of the present invention is to design an internal combustion engine in such a manner that the disadvantages of the known combustion engines are overcome.

GENERAL DESCRIPTION OF THE INVENTION:

In accordance with the present invention there is provided an internal combustion engine comprising an annular cylinder in the form of a hollow toroid, and a plurality of pistons fixedly mounted relative to one another and rotatable as a unit to sweep out circular paths within the toroid, an output shaft coaxial with the axis of the toroid and rigidly connected to the pistons and, spaced around the toroid, a plurality of inlet valves, outlet valves and ignition means, the toroid further including at least a pair of separating walls adapted to move substantially radially inwardly and outwardly to divide the toroid inner space into at least two chambers, means to withdraw the separating walls to allow the passage of a piston and immediately thereafter reinsert it, and means associated with each separating wall to abstract from the interior of the toroid compressed gas upstream of the wall, as viewed by a moving piston, and to release such compressed gas from the chamber downstream of said well immediately after the reintroduction of said wall into the toroid chamber.

Preferably the control of the separating walls is effected by means coupled mechanically to the central output shaft, for example cam means. In one particular embodiment the central output shaft may bear a plurality of cams operative to withdraw the walls periodically from the toroid chamber as the shaft and piston assembly rotates, and return springs may be provided to reinsert the walls into the toroid chamber.

Most preferably the toroid is provided with two inlet valves or ports, two exhaust valves or ports, two spark plugs and two separating wall units. Preferably the pistons are mounted about the periphery of a disc which is rigidly connected to the output shaft. Annular sealing rings may be provided to seal against the escape of gas from the interior of the toroidal chamber past the faces of the disc.

As will appear more specifically from the description of a preferred embodiment below, constructing an internal combustion engine in this way leads to substantial improvements in evenness of running and in the obtainable torque and efficiency. Compared to rotary piston engines such as the Wankel engine a fourfold increase in torque per cycle, and compared with an Otto or Diesel engine an eightfold increase in torque per four stroke cycle, can be achieved. The symmetry of the piston arrangement and its direct connection to the output drive shaft makes for great uniformity and evenness of running. There is no need at all to provide a crankshaft mechanism. By appropriate design, construction costs, fuel requirements for a given output, constructional size and environmental impact can all be diminished. In addition, the simple construction of the invention materially assists installation, maintenance and servicing. The working life of the engine may be quite long.

Obviously the overall output power of the engine will depend on the specific design; increased power may be obtained by increasing the size of the cylinders. Moreover two or more toroids arranged coaxially can be used.

A simple comparison with a standary multi-cylinder reciprocating piston engines is instructive:

(a) in place of a plurality of cylinders, only one annular shape cylinder is used
(b) in place of the oscillating movement of the pistons four pistons rotate in the same sense in the annular cylinder, the four being symmetrically arranged and directly connected with the drive shaft (satellite principle)
(c) in place of the customary eccentrically formed crankshaft the movement of the drive shaft is effected directly by the pistons, whereby an ideal regularity is achieved
(d) the novel construction required no cylinder head
(e) the constructional problems are substantially diminished.

SPECIFIC DESCRIPTION OF PREFERRED EMBODIMENT

In the accompanying drawings one embodiment of the invention is illustrated by way of example and described in what follows. The drawings show:

FIG. 1 an illustration of the principle of the satellite motor, wherein (a) is a section in elevation and (b) a section in side view FIG. 2 is a diagrammatic illustration of the principle of construction of the separating wall and FIG. 3 is a set of diagrams illustrating the sequence of operation.

FIG. 4 shows in enlarged scale details of the piston and the sealing means associated to it.

FIGS. 1 and 2 show the basic construction of an engine according to the invention.

Figure 1B:
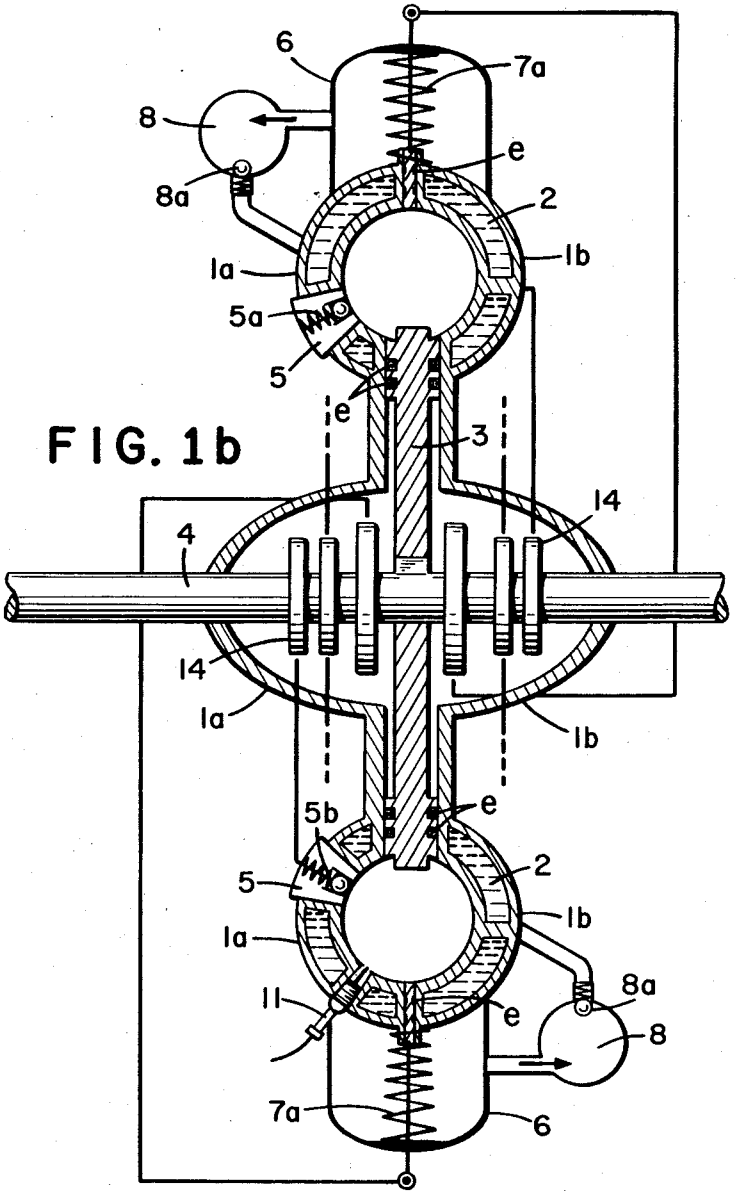

According to said figures the engine comprises two annular cylinder block halves 1*a*, 1*b* having integral cooling water channels 2. Within the cylinder formed by said block halves 1*a*, 1*b* there are rotating four pistons a, b, c, d connected to a central carrier disc 3 which in turn is connected to a central output shaft 4. Sealing rings (e) are provided to seal against the escape of gas from the interior of the cylinder past the faces of the disc 3. The output shaft 4 carries two groups of control cams 14, the function of which will be described later on.

Furthermore the engine comprises at diametrically opposite sides compression chambers 5 within the wall of the cylinder, each of which is provided with a pressure valve 5*a* and a control valve 5*b*.

Furthermore there are provided two diametrically opposite separating walls 7, each of which can be moved between a position within the cylinder and a position within a housing 6, said separating walls 7 being biased by means of a spring 7*a* towards the position within the cylinder.

Moreover, there are provided two collection chambers 8, each of which comprises a pressure valve 8*a*.

An engine according to FIG. 1 still comprises at diametrically opposite positions two inlet control valves 9, two exhaust control valves 10 and two spark plugs 11.

The several cams or cam discs serve to control the several valves 5*b*, 9, 10 and the separating walls 7. The control of valves by cams is known in the art, so that no further detailed description is given.

As can be seen from FIG. 1*b*, apart from the sealing rings (e) which provide a seal between the block halves 1*a*, 1*b* and the central piston carrier disc 3 there is an additional sealing ring e providing a seal between the block halves 1*a*, 1*b* on the radially outer side of the cylinder.

As it is evident from the drawing, in order to allow the disc 3 to turn, and the pistons a, b, c, d to travel round and round the annular cylinder, the separating walls 7 must be regularly retracted into their housings 6 and moved to the position within the annular cylinder to enable the pistons a, b, c, d to pass. As this happens, in each case during a compression stroke, some compressed fuel/air mixture may come into the housings 6. This passes then into the collection chambers 8 and is subsequently reintroduced into the cylinder via valve 8*a* and the inlet control valve 9. Most of the mixture passes into the compression chamber 5 via valve 5*a*, whence it is released via valve 5*b* into the small chamber formed between the wall 7 which has just been reintroduced into the annular cylinder and the rear face of the piston which has just passed. At that stage, ignition is effected and the explosion of the mixture then pushes the piston forward. All relevant valve timings can be cam controlled from the output shaft 4, either directly mechanically or electro-mechanically or pneumatically. Electronic control and regulating systems can be used to reduce costs and increase operational efficiency.

Figure 3:
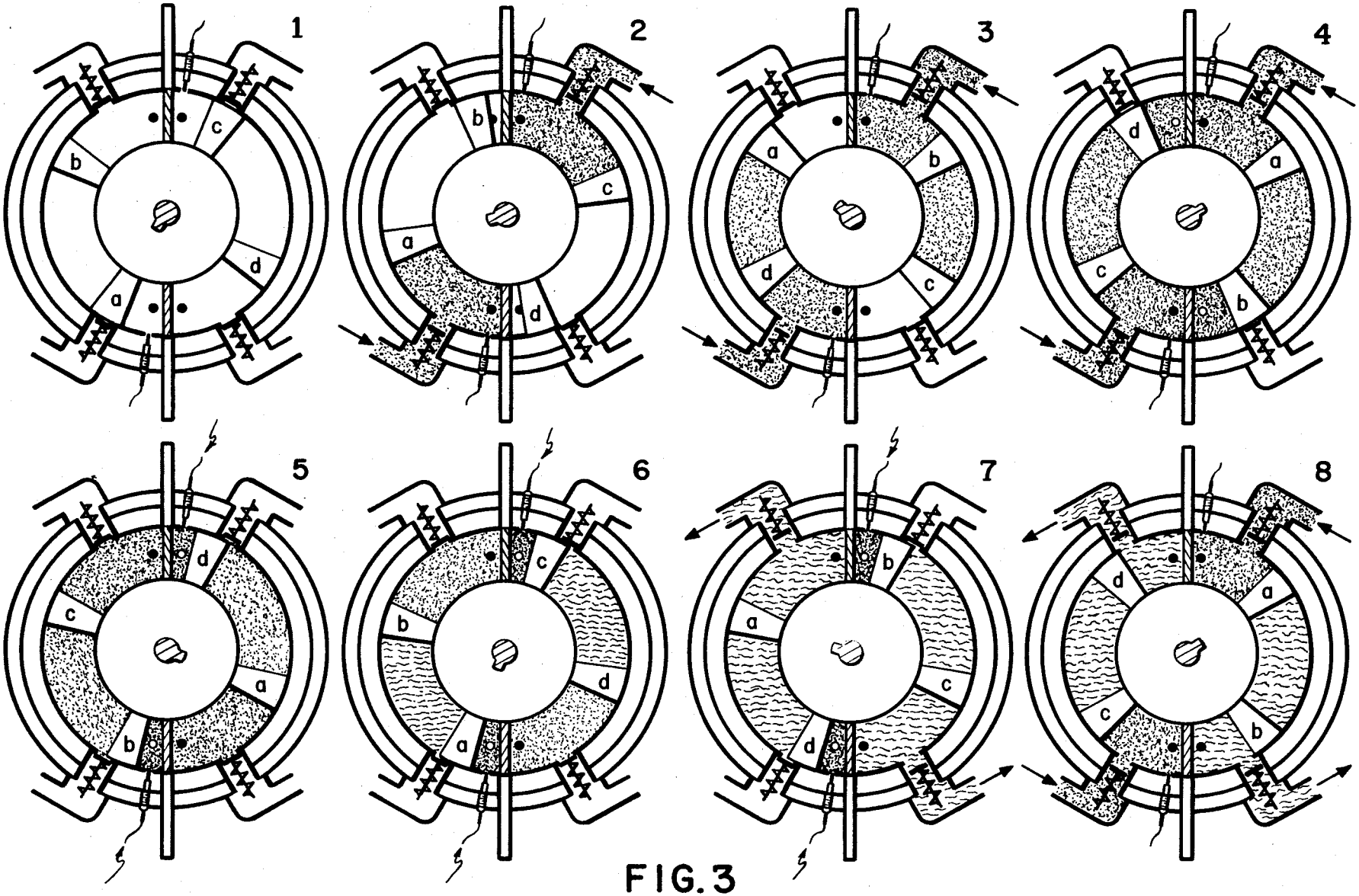

The sequence of operation of the engine illustrated is shown in FIG. 3, which shows diagrammtically the four stroke mode of operation of the internal combustion satellite engine in steps 1 to 8, during which the shaft 4 turns through an operating cycle of 540°. The sequence of operations is described in detail as follows:

Stage 1: shows what might be the staring position of the pistons a, b, c, d in the shut off condition. Starting takes place by a customary starter system which turns the output shaft in the clockwise direction according to FIG. 3.

Stage 2: by means of the forwards movement of pistons (a) and (c) and the simultaneous opening of the inlet valves 9 the first induction phase starts. The fuel/air mixture is drawn into the chambers constituted by the closed separating walls 7, and the walls of the combustion cylinder between the upper separating wall 7 and the rear side of piston (c) and between the lower separating wall 7 and the rear side of piston (a).

Stage 3: the pistons (b) and (d) pass the separating walls 7 which have in the meantime been opened by means of the cam drive. Directly after said pistons have passed the zone of the separating walls 7, the walls 7 are reinserted again. Simultaneously the second induction phase begins, since the inlet valves 9 are still opened, for pistons (b) and (d) now work in two ways. The front sides of these pistons compress the fuel/air mixture initially sucked in by pistons (a) and (c). The rear sides of pistons (b) and (d) simultaneously effect the second induction phase.

Stage 4: pistons (d) and (b) now compress the enclosed gas volume so strongly (compression) that the pressure valves 5*a* of the compression chambers 5 open and the compressed fuel/air mixture passes into the compression chambers 5. Simultaneously the rear sides of pistons (a) and (c) effect a third induction phase.

Stage 5: the cam drive has retracted the separating walls 7 for a short time in order to allow pistons (b) and (d) to pass and immediately after said pistons have passed the separating walls 7 divide the operating cylinder again. Directly thereafter, the control valves 5*b* of the compression chambers 5 are opened, so the compressed fuel/air mixture comes into the spaces between the rear sides of pistons (d) and (b) and the separating walls 7. Immediately thereafter the ignition and combustion of the fuel takes place. The flow speeds (transport speeds) which arise increase the burning speed substantially and accordingly lead to a shorter combustion time and less tendency to knocking. The high gas pressure from the explosion drives the pistons (d) and (b) forwards and simultaneously the inlet valves 9 are closed by the cam drive.

Stage 6: the front sides of pistons (a) and (c) now compress the fuel mixture which then undergoes the processes as have been described in Stage 5, and the second explosion phase occurs. At the same time the front sides of pistons (d) and (b) effect the compression of the fuel from the third induction phase. The exhaust gases from the first explosion phase are located in the spaces between the rear sides of pistons (d) and (b) and the front sides of pistons (a) and (c).

Stage 7: shortly before the beginning of the third explosion phase the exhaust valves 10 open in order that the exhaust gases from the first explosion can flow out. The evacuation of these is effected in this connection by the front sides of pistons (a) and (c). After closure of the separating walls 7 the third explosion phase takes place. By further movement of the pistons the combustion cylinder is now cleared of the waste gases from the second explosion phase by the front faces of pistons (d) and (b).

Stage 8: the front faces of pistons (a) and (c) now clear out the combustion cylinder of the waste gases from the third explosion phase. Thereafter the outlet valves 10 are closed, and the separating walls 7 are retracted in order to allow the pistons (a) and (c) to pass. The subsequent closure of the separating walls 7 and opening of the inlet valves 9 introduces the second operating cycle.

Figure 1A:
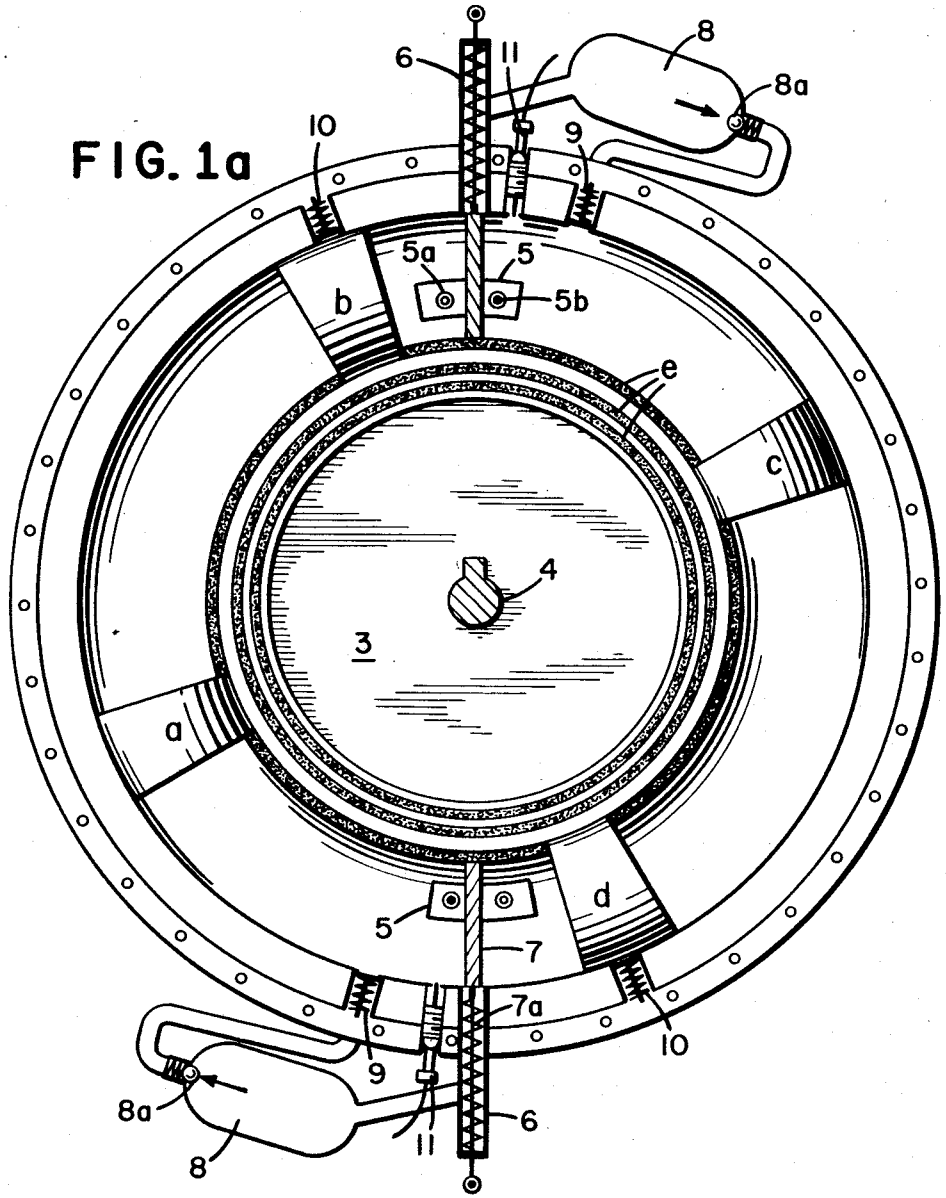

FIG. 4 shows in enlarged scale some details of the construction of the carrier disc 3 and one of the pistons (a). It should be understood that the piston (a) is shown itself in a still enlarged scale, mainly as its axial extension is concerned. In practice, the extension of piston (a) in circumferential or axial direction corresponds to the said extension or dimension as shown in FIG. 1*a*. The enlarged scale has been selected in order to more clearly show the sealing means which effect a seal between the piston (a) and the inner surface of the cylinder.

As can be seen, the said seal comprises a preferably continuous sealing strip 12 which is arranged in a continuous helical groove formed in the outer surface of piston (a). The sealing strip 12 consists, for example, of metal, preferably steel as it is common in the field of question.

Furthermore as can be seen from FIG. 2 the separating wall housings 6 are inserted into a suitable recess of the cylinder block halves 1*a*, 1*b*. If necessary, suitable sealing means could be used to effect a seal between the outer surface of the housing 6 and the opposing surfaces of the recess formed in the cylinder block halves 1*a*, 1*b*.

Further as far as the separating walls 7 are concerned, according to a not-shown modified embodiment each sealing wall 7 could be formed by two separate half discs. Each half disc will be arranged in a lateral housing and the arrangement is such that both half discs are moved simultaneously either to a position within the cylinder or to a position outside the cylinder within the respective housing. In this embodiment the free edges of the half discs contact each other in the position within the cylinder. An advantage of this embodiment is that the distance, over which each half disc must move upon actuation, is only the half of the distance of movement of a unitary separating wall 7.

Furthermore it should be understood that each cylinder block half 1*a*, 1*b* comprises a half of a casing through which the output shaft 4 passes and which is filled with lubrication oil. Although not shown it is preferred that the piston carrier disc 3 in its area within the oil casing comprises some through holes by which some circulation of the oil will be generated. As can be seen from FIG. 1*b* the cam means are also within the oil filled casing.

I claim:

1. In a rotational piston-combustion engine rotating about its center line comprising an annular cylinder (1*a*,1*b*), a plurality of pistons (a,b,c,d) fixedly mounted relative to one another and movable as a unit to sweep out circular paths within the annular cylinder, an actuation shaft (4) coaxial with the axis of the annular cylinder and rigidly connected to the pistons, a plurality of separating walls (7) adapted to move substantially radially inwardly and outwardly to divide the inner space of the annular cylinder into respective chambers, an outlet valve (10) upstream of each separating wall with respect to the rotational direction of the piston, an inlet valve (9) downstream of each separating wall, an ignition means (11), means to retract the separating walls and to allow the passage of a piston and immediately thereafter reinsert them into the cylinder chamber, and a compression chamber (5) in the outer wall of the annular cylinder within the range of each separating wall having an automatically opening pressure valve (5*a*) upstream of the separating wall with respect to the rotational direction of the piston and a control valve (5*b*) downstream of the separating wall, the improvement comprising two diametrically opposed separating walls (7) and four pistons (a–d) arranged in equal circumferential distances to provide, in a complete operating cycle of 540° six induction phases, six compression phases, six expansion phases and six exhaust phases taking place, and the interior of the sealed housings (6) fixedly connected with the annular cylinder and receiving the separating walls (7) being connected each with a collection chamber (8) disposed outside of the cylinder which in its turn is connected with the respective induction opening (inlet valve 9) through a pressure valve (8*a*).

2. The combustion engine of claim 1 wherein the control of the separating walls of the separating wall units is effected by means coupled mechanically to the central output shaft.

3. The combustion engine of claim 1 wherein the output shaft bears a plurality of cams operative to retract the separating walls periodically from the toroid chamber as the output shaft and piston assembly rotates, and return springs are provided to reinsert the separating walls into the toroid chamber.

4. The combustion engine of claim 1 wherein the sealing of the annular cylinder is effected by a sealing ring between two cylinder halves at their outer flanges and further sealing rings between the parts of the cylinder running towards the central axis and a disc carrying the pistons.

5. The combustion engine of claim 1 including sealing means in the outer surface of each piston said sealing means comprising a helical groove in which there is arranged a steel sealing strip.

6. In the combustion engine according to claim 1, wherein the separating walls (7) are electromagnetically actuated.

* * * * *